US008086131B2

(12) United States Patent
Koshida

(10) Patent No.: US 8,086,131 B2
(45) Date of Patent: Dec. 27, 2011

(54) IMAGE FORMING APPARATUS

(75) Inventor: Kohei Koshida, Toride (JP)

(73) Assignee: Cannon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/981,614

(22) Filed: Dec. 30, 2010

(65) Prior Publication Data

US 2011/0097102 A1 Apr. 28, 2011

Related U.S. Application Data

(63) Continuation of application No. 11/530,156, filed on Sep. 8, 2006, now Pat. No. 7,890,014.

(30) Foreign Application Priority Data

Sep. 13, 2005 (JP) ..... 2005-265421

(51) Int. Cl.
*G03G 21/20* (2006.01)

(52) U.S. Cl. ..... 399/92

(58) Field of Classification Search ..... 399/92
See application file for complete search history.

(56) References Cited

U.S. PATENT DOCUMENTS

| | | | | |
|---|---|---|---|---|
| 5,325,158 | A | 6/1994 | Guelfo et al. | |
| 6,219,497 | B1 | 4/2001 | Hauman et al. | |
| 7,146,120 | B2 * | 12/2006 | Ogane et al. | 399/92 |
| 7,251,426 | B2 | 7/2007 | Koshida | |
| 2002/0076229 | A1 | 6/2002 | Allmendinger | |
| 2006/0222386 | A1 | 10/2006 | Koshida et al. | |
| 2006/0222394 | A1 | 10/2006 | Koshida | |
| 2006/0263128 | A1 | 11/2006 | Takematsu et al. | |

FOREIGN PATENT DOCUMENTS

| | | | |
|---|---|---|---|
| JP | 1-266558 | A | 10/1989 |
| JP | 4-104264 | A | 4/1992 |
| JP | 4-256976 | A | 9/1992 |
| JP | 5-61374 | A | 3/1993 |
| JP | 5-119669 | A | 5/1993 |
| JP | 6-019246 | A | 1/1994 |
| JP | 6-075490 | A | 3/1994 |
| JP | 10-074017 | A | 3/1998 |
| JP | 10-133440 | A | 5/1998 |
| JP | 10-268735 | A | 10/1998 |
| JP | 2001-265142 | A | 9/2001 |
| JP | 2002-031984 | A | 1/2002 |

(Continued)

OTHER PUBLICATIONS

Final Notice of Reasons for Rejection dated May 9, 2011, in counterpart Japanese Application No. 2005-265421.

*Primary Examiner* — David Gray
*Assistant Examiner* — Erika J Villaluna
(74) *Attorney, Agent, or Firm* — Fitzpatrick, Cella, Harper & Scinto

(57) ABSTRACT

An image forming apparatus has: a rotary member which conveys a sheet; a blowing device which blows a cooling air to cool the rotary member; and a blow-off member which blows the cooling air from the blowing device toward the rotary member. The cooling air is blown toward the portion of the rotary member serving as a downstream side of the rotary member and a blow-off direction of the cooling air is opposite to a rotating direction of the rotary member.

18 Claims, 12 Drawing Sheets

FOREIGN PATENT DOCUMENTS

| | | | |
|---|---|---|---|
| JP | 2002-287564 | A | 10/2002 |
| JP | 2002-311732 | A | 10/2002 |
| JP | 2003-076209 | A | 3/2003 |
| JP | 2003-255809 | A | 9/2003 |
| JP | 2003-330298 | A | 11/2003 |
| JP | 2004-109732 | A | 4/2004 |
| JP | 2004-157314 | A | 6/2004 |

* cited by examiner

IMAGE FORMING APPARATUS

BACKGROUND OF THE INVENTION

Field of the Invention

The invention relates to an image forming apparatus.

Description of the Related Art

Hitherto, in an image forming apparatus such as electrophotographic apparatus, electrostatic recording apparatus, or the like, after a toner image was transferred onto a sheet, the sheet is conveyed to a fixing device, and the toner image is fixed by heating and pressing it in the fixing device, thereby forming an image onto the sheet.

FIG. 13 shows a construction of such a conventional image forming apparatus. Reference numeral 100 denotes an image forming apparatus; 101 an image forming apparatus main body (hereinbelow, referred to as an apparatus main body); 102 an image forming unit; and 5 a fixing roller pair serving as a fixing apparatus.

The image forming unit 102 has: photosensitive drums (a to d) for forming toner images of four colors of yellow, magenta, cyan, and black; an exposing device 6 for forming an electrostatic latent image onto each of the photosensitive drums by irradiating a laser beam on the basis of image information; and the like. The photosensitive drums (a to d) are driven by motors (not shown). A primary charging unit, a developing unit, and a transfer charging unit (which are not shown) are arranged around each drum and have been constructed in unit shapes as process cartridges 1*a* to 1*d*.

Reference numeral 2 denotes an intermediate transfer belt which is rotated in the direction shown by an arrow. By applying transfer biases to the intermediate transfer belt 2 by transfer charging units 2*a* to 2*d*, the toner images of the respective colors on the photosensitive drums are sequentially multiplex-transferred onto the intermediate transfer belt 2. Thus, a full-color image is formed on the intermediate transfer belt.

Reference numeral 3 denotes a secondary transfer unit for transferring the full-color image which have sequentially been formed on the intermediate transfer belt 2 onto a sheet P; 5 the fixing unit for fixing the image on the sheet onto the sheet P; and 11 a discharge roller pair for ejecting the sheet P on which the image has been fixed to a discharge tray 7.

The image forming operation of the image forming apparatus 100 constructed as mentioned above will now be described.

When the image forming operation is started, first, the exposing device 6 irradiates the laser beam on the basis of the image information which is supplied from a personal computer (not shown) or the like, and sequentially exposes the surfaces of the photosensitive drums (a to d) which have uniformly been charged to a predetermined polarity and a predetermined electric potential, thereby forming the electrostatic latent images onto the photosensitive drums. After that, the electrostatic latent images are developed by the toner and visualized.

For example, first, the laser beam according to an image signal of a yellow component color of an original is irradiated to the photosensitive drum (a) through a polygon mirror and the like of the exposing apparatus 6, thereby forming the yellow electrostatic latent image onto the photosensitive drum (a). The yellow electrostatic latent image is developed by the yellow toner supplied from the developing unit and visualized as a yellow toner image.

Subsequently, in association with the rotation of the photosensitive drum (a), when the toner image flows into a primary transfer unit with which the photosensitive drum (a) and the intermediate transfer belt 2 are come into contact, the yellow toner image on the photosensitive drum (a) is transferred to the intermediate transfer belt 2 by a primary transfer bias applied to the transfer charging unit 2*a* (primary transfer).

Subsequently, when a portion holding the yellow toner image on the intermediate transfer belt 2 is moved, a magenta toner image formed on the photosensitive drum (b) so far by a method similar to that mentioned above is transferred on to the yellow toner image on the intermediate transfer belt 2. Similarly, as the intermediate transfer belt 2 moves, a cyan toner image and a black toner image are overlaid and transferred onto the yellow toner image and the magenta toner image in the primary transfer unit, respectively. Thus, the full-color toner image is formed on the intermediate transfer belt 2.

In parallel with the toner image forming operation, the sheets P enclosed in a paper feed cassette 4 are fed out one by one by a pickup roller 8 and flow into a resist roller 9. After timing is matched by the resist roller 9, the sheet is conveyed to the secondary transfer unit 3. In the secondary transfer unit 3, the toner images of four colors on the intermediate transfer belt 2 are transferred onto the sheet P in a lump by a secondary transfer bias which is applied to a secondary transfer roller 3*a* (secondary transfer).

Subsequently, the sheet P to which the toner images have been transferred as mentioned above is guided by a conveying guide 20 provided between the secondary transfer unit 3 and the fixing roller pair 5 and conveyed to the fixing roller pair 5 constructed by a heating roller 5*a* and a pressing roller 5*b*. By the fixing roller pair 5, the sheet P is heated and pressed and fixed. Thus, the toners of the respective colors are melted and color-mixed and a full-color print image fixed to the sheet P is obtained. After that, the sheet P is ejected to the discharge tray 7 by the discharge conveying roller pair 11 provided on the downstream of the fixing roller pair 5.

In recent years, in the image forming apparatus, miniaturization and high speed of the apparatus are strongly demanded. In such an image forming apparatus, a technical problem which occurs frequently is a problem that in the fixing roller pair 5, the heat is applied to the sheet and the conveyed sheet becomes a heat source, thereby raising a temperature of the whole apparatus.

As another problem, there is a problem of an inter-sheet adhesion in which if the heat-applied sheets themselves are continuously delivered and stacked, the obverse surface of one sheet and the reverse surface of another sheet which faces the sheet are adhered. Such an inter-sheet adhesion is liable to occur in the case where heating performance of the fixing roller pair 5 (fixing device) is improved in order to improve fixing performance of the image on an OHT sheet, thick paper, or the like or the case where thin sheets of paper to which the duplex printing has been performed are continuously stacked.

Among the problems, a technique regarding how to effectively cool the sheet after the fixing becomes an important subject. To accomplish such a subject, hitherto, a cooling fan is arranged on a conveying path after the fixing, thereby cooling the heat applied to the sheet.

Further, for example, as shown in FIG. 13, a cooling roller pair 10 is arranged on the downstream side in the conveying direction of the fixing roller pair 5, the air is blown to the cooling roller pair 10 by a cooling fan (not shown), and the cooling roller pair 10 is cooled, thereby realizing a cooling effect of the sheet (JP-A-2004-109732).

Hitherto, as a fixing device for fixing the toner image onto the sheet, there is a heat roller fixing system in which the sheet is heated while being sandwiched with a pressure and conveyed by the heating roller (fixing rotary member) 5*a* held to a desired temperature and the pressing roller (pressing rotary member) 5*b* which is come into pressure contact with the heating roller 5*a*. There is also a fixing device in which a fixing belt, a heating film, or the like which is come into pressure contact with the pressing roller and rotated and has been heated by a heating source is used in place of the heating roller.

However, in such a fixing device, in the case where the sheets of a small size in which a length in the direction (hereinbelow, referred to as a width direction) which crosses perpendicularly the sheet conveying direction is shorter than that of the sheet of the maximum size are continuously fixed in a fixing region, a temperature of a non-paper-passage surface of the heating roller 5*a* excessively rises. This is because if the sheets of the small size are continuously allowed to pass, in the non-paper-passage region of the heating roller 5*a* where no sheet passes, the heat is partially accumulated because there is no heat-take-away by the sheet.

Such a phenomenon is called an edge portion temperature elevation or a non-paper-passage portion temperature elevation of the fixing device. If the temperature of the edge portion of the fixing device rises as mentioned above, a hot offset of the image to the heating roller occurs and, if the temperature exceeds a temperature elevation limit of the component elements of the fixing member, it results in a damage of the parts.

To prevent such a problem, therefore, in the conventional fixing device, self heat radiation cooling is executed for a predetermined time or until a value of a detection signal of detecting means for detecting the temperature of the heating roller or the pressing roller in the non-paper-passage region is equal to a predetermined value. After temperature distribution of the whole region in the width direction became almost uniform by such self heat radiation cooling, the next sheet is allowed to pass.

However, in order to make the temperature distribution of the whole region in the width direction almost uniform by performing the self heat radiation cooling, a cooling time of tens of seconds to about a few minutes, that is, a down-time is necessary and the next paper passage cannot be performed for such a down-time, so that the improvement of the productivity is obstructed.

Therefore, to prevent such a non-paper-passage portion temperature elevation, there has been known a construction in which a blowing fan is provided for the fixing device and the air is blown to the heating roller or the pressing roller in the non-paper-passage region, thereby suppressing the temperature elevation. Further, there is also a construction in which when the cooling air is blown to the non-paper-passage region side from the cooling fan, a length in the width direction of a ventilation port is adjusted in accordance with a width of sheet which is used, thereby preventing the non-paper-passage portion temperature elevation also to the sheets of different sizes (refer to JP-A-2003-076209).

However, in such a conventional image forming apparatus, for example, in the case where the air is blown by a cooling fan 170 and the cooling roller pair 10 is cooled as shown in FIG. 14, there is the following problem.

If the apparatus is miniaturized, particularly, in the case where the sheet P has been conveyed, the air after the sheet was cooled by the cooling fan 170 flows into the fixing roller pair 5 in dependence on the direction of a duct 171. If the air after the cooling flowed into the fixing roller pair 5, the temperature of the fixing roller pair 5 decreases and a heat generation amount of the heating roller 5*a* increases.

Further, as shown in FIG. 15, when the sheet is passing through the fixing roller pair 5, the air after the cooling collides with the sheet P and, thereafter, flows into the conveying path before the fixing through the outer periphery of the heating roller 5*a*.

When the air flows into the fixing roller pair 5 as mentioned above, it is heated. Therefore, there is also a problem that, when the heated air flows into the image forming unit 102 as well as the secondary transfer unit 3 after that, the temperature of the image forming unit 102 rises and the toner is melted in the image forming unit 102.

Also in the case of taking a measure for the temperature elevation by cooling the non-paper-passage portion of the heating roller 5*a* of the fixing roller pair 5 by a cooling fan 172 as shown in FIG. 16, the cooling effect to the non-paper-passage portion cannot be sufficiently obtained in dependence on a way of blowing the cooling air and the productivity is deteriorated.

There is also a problem that the air after the non-paper-passage portion of the fixing roller pair 5 was cooled by the cooling fan 172 also flows into the conveying path on the upstream side more than the fixing roller pair 5 in dependence on the direction of a duct 173, an influence is exercised on the temperature elevation of the image forming unit, and the toner is melted in the image forming unit.

SUMMARY OF THE INVENTION

The invention is made to solve such problems and it is, therefore, an object of the invention to provide an image forming apparatus which can efficiently cool a rotary member for conveying a sheet even in the case where the miniaturization and a high speed of the apparatus are realized.

According to the invention, there is provided an image forming apparatus, comprising: a rotary member which conveys a sheet; a blowing device which blows a cooling air to cool the rotary member; and a blow-off member which blows off the cooling air from the blowing device toward the rotary member, wherein the cooling air is blown off by the blow-off member toward the portion of the rotary member on a downstream side of the rotary member and a blow-off direction of the cooling air is opposite to a rotating direction of the rotary member.

Further features of the present invention will become apparent from the following description of exemplary embodiments with reference to the attached drawings.

DESCRIPTION OF THE EMBODIMENTS

The best mode for carrying out the invention will be described in detail hereinbelow with reference to the drawings.

Figure 1:
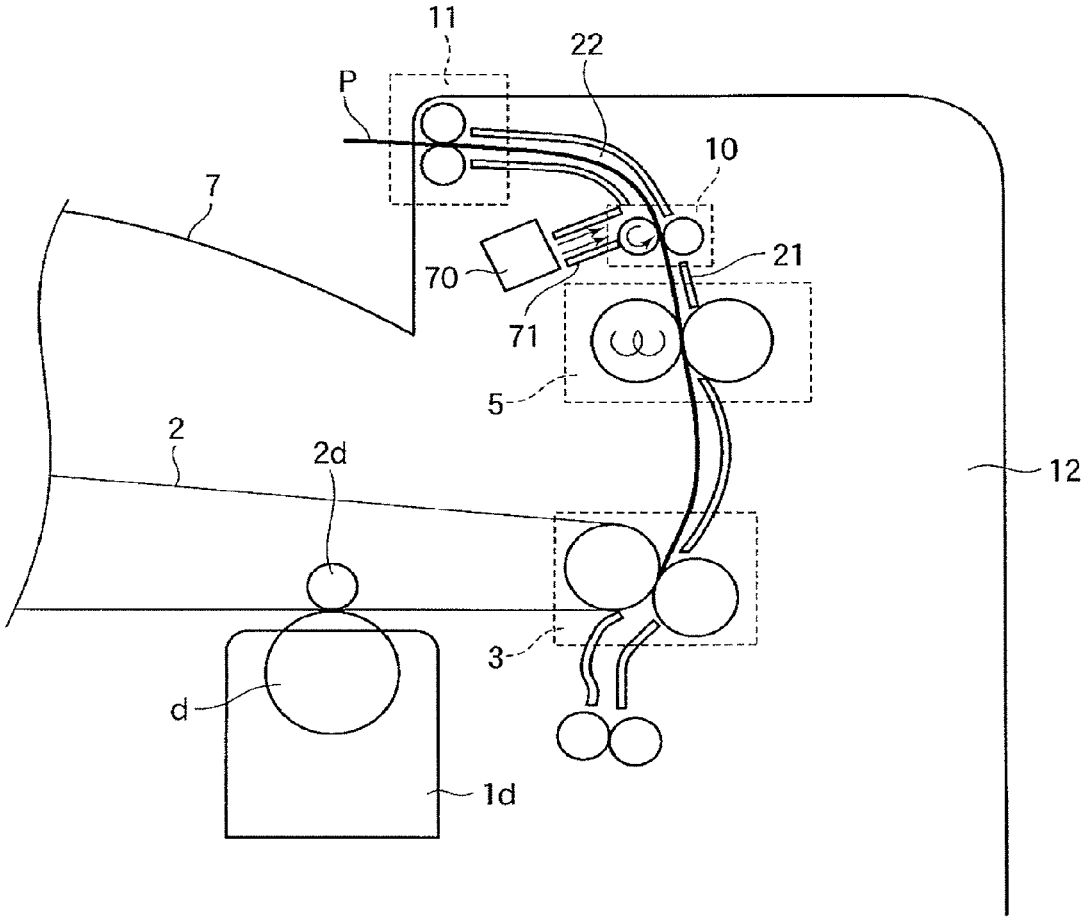
FIG. 1 is an enlarged diagram of a main section of an image forming apparatus according to the first embodiment of the invention.
Figure 13:
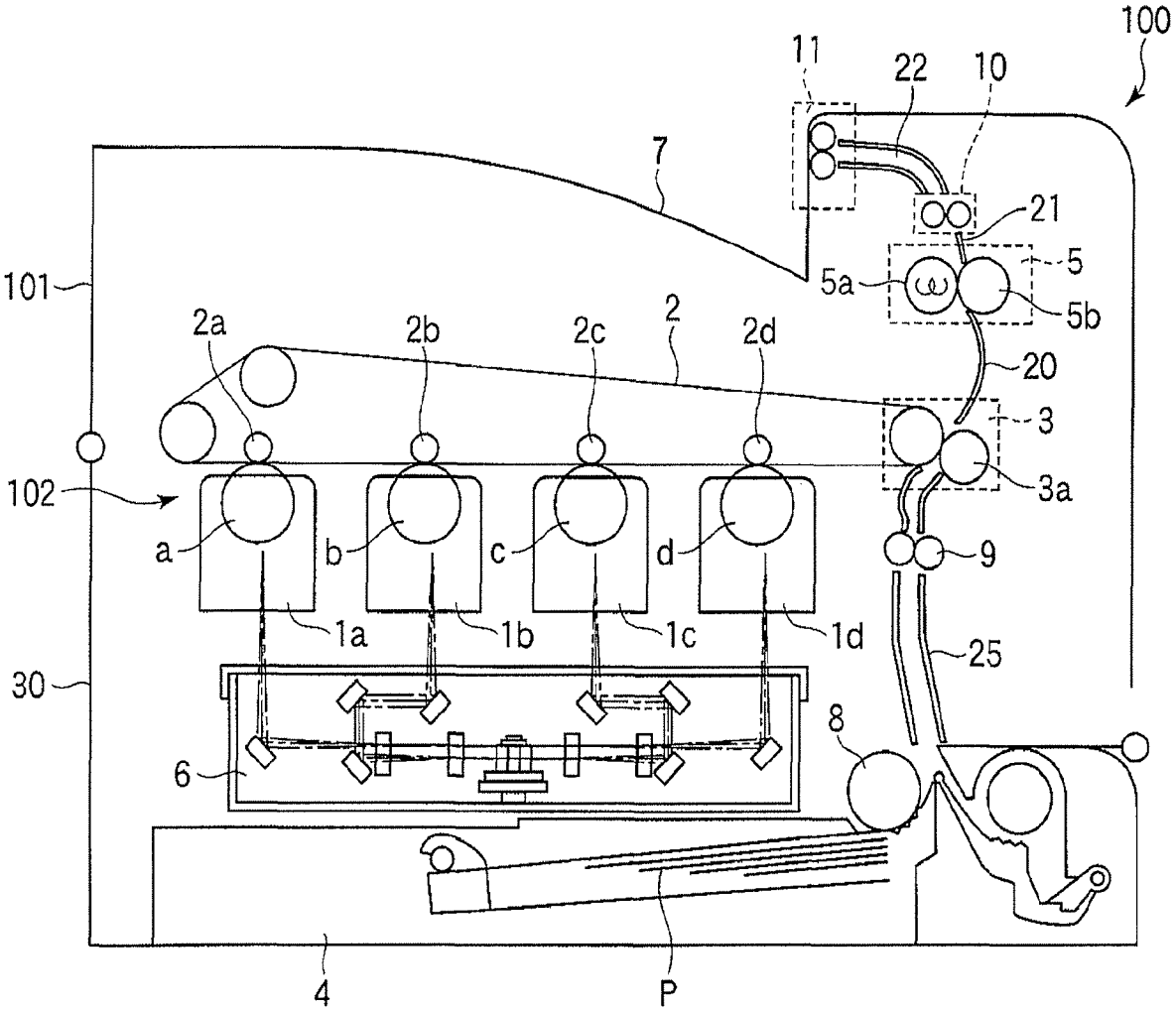
FIG. 13 is a diagram showing a construction of a conventional image forming apparatus.
Figure 14:
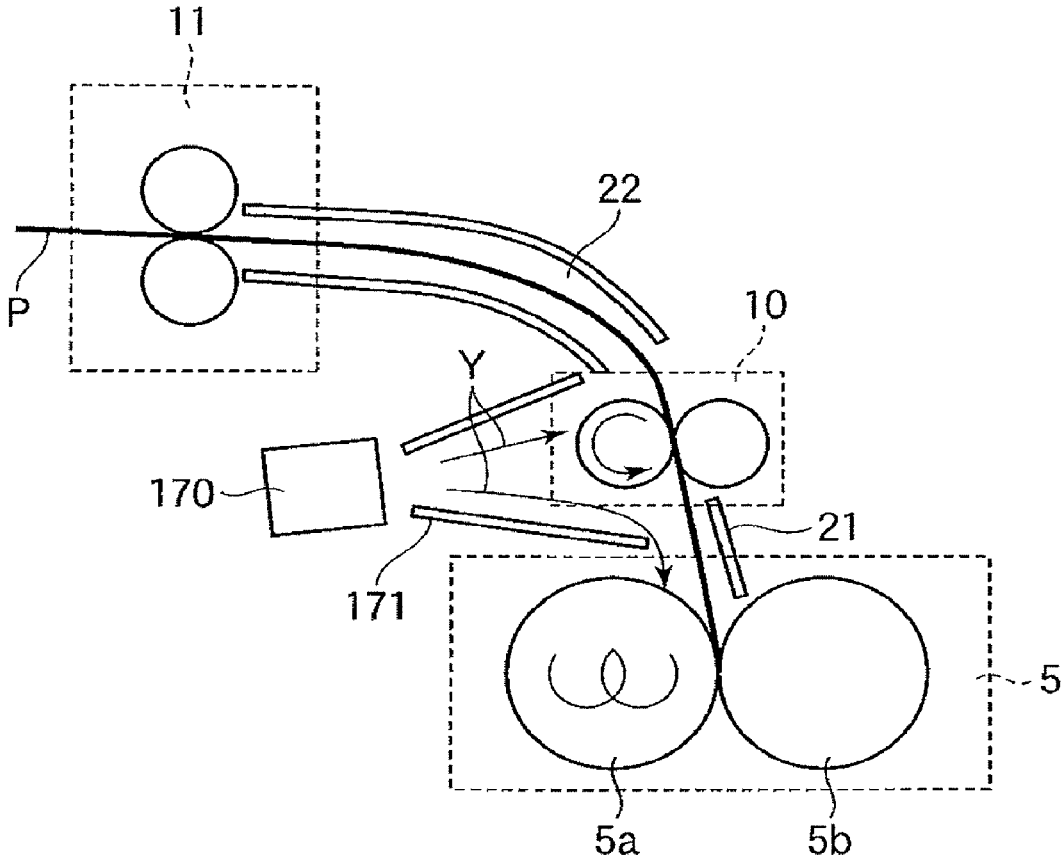
FIG. 14 is a diagram showing a state of cooling a cooling roller provided for the conventional image forming apparatus.
Figure 15:
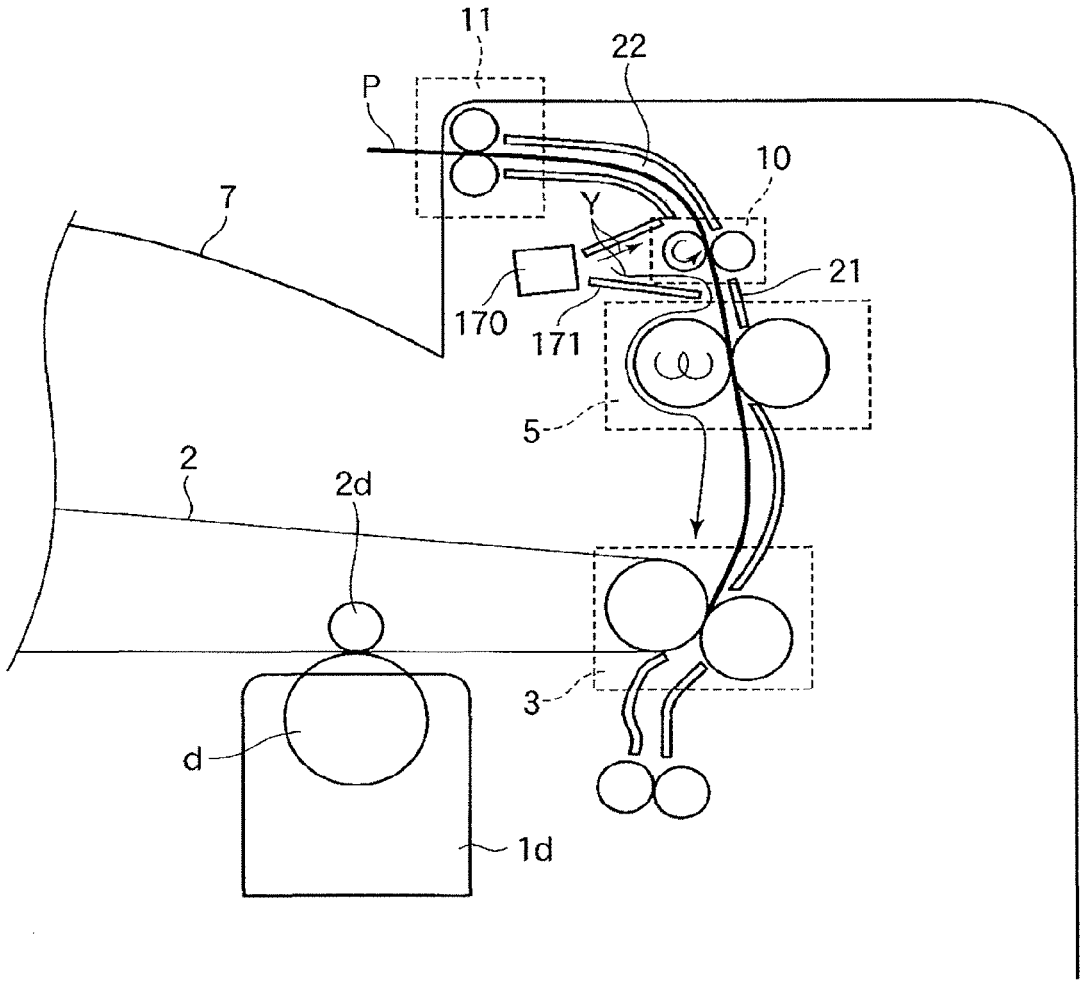
FIG. 15 is a diagram showing a flow of the cooling air when the cooling roller is cooled.

FIG. 1 is an enlarged diagram of a main section of an image forming apparatus according to the first embodiment of the invention. In FIG. 1, the same or similar portions as those in FIG. 13 are designated by the same reference numerals.

In FIG. 1, reference numeral 70 denotes a cooling fan as a blowing device provided on the downstream side of the fixing roller pair 5. The cooling fan 70 is provided almost in parallel with the cooling roller pair 10 serving as an endothermic roller pair with respect to the axial direction.

By rotating the cooling fan 70 and generating the cooling air, the cooling roller pair 10 which is come into contact with the fixed sheet P is cooled. Thus, when the sheet P passes through the cooling roller pair 10, the heat of the sheet P is taken away and a temperature of the sheet P decreases by heat conduction with the cooling roller pair 10. After that, the cooling roller pair 10 has been cooled by the air blown from the cooling fan 70 and the temperature of the cooling roller pair 10 has decreased until the next sheet P is conveyed, so that the next sheet can be cooled.

Each of cooling rollers (endothermic rollers) 10*a* and 10*b* (shown in FIG. 2) serving as rotary members constructing the cooling roller pair 10 provided on the downstream of the fixing roller pair 5 uses aluminum (Al) as a core. Further, a PFA (tetrafluoroethylene-perfluoro alkyl vinyl ether copolymer) layer serving as a releasing layer is formed on the roller surface.

A construction of the cooling rollers 10*a* and 10*b* is not limited to such a construction but, in accordance with a distance from the fixing roller pair 5 to the discharge tray 7 or a conveying velocity of the sheet P, another metal such as iron or SUS can be used for the core or a releasing layer of another material can be used for the surface of the roller. A material of a resin system such as POM (polyacetal) can be also used for the roller.

Figure 2:
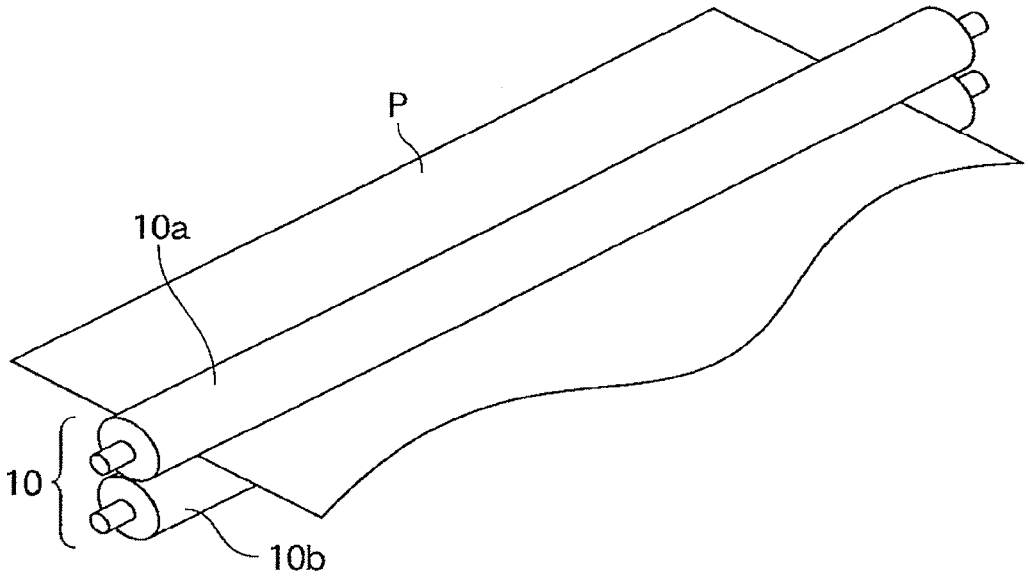
FIG. 2 is a perspective view showing cooling rollers provided for the image forming apparatus.
Figure 17:
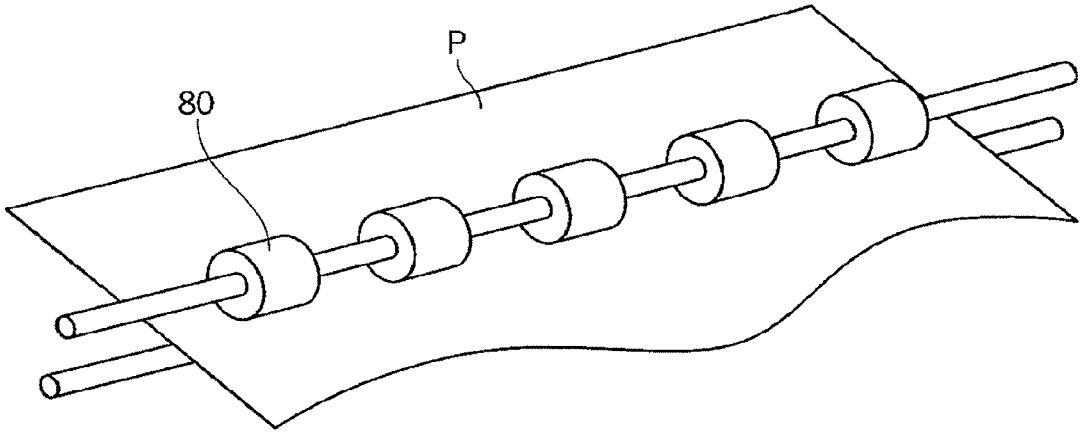
FIG. 17 is a diagram showing the conventional cooling roller.

The cooling rollers 10*a* and 10*b* are cylindrical rollers in which an outer peripheral surface is continuous in the width direction as shown in FIG. 2. By designing the cooling rollers 10*a* and 10*b* in such a shape, the heat can be uniformly absorbed from the sheet P in the width direction as compared with the case of rollers 80 in a shape in which an outer peripheral surface is interrupted at positions on the way of the width direction as shown in FIG. 17. Further, since joint portions of the rollers, edge portions of the rollers, or the like are not come into contact with the image surface, a defective image in which a trace or stripe of the roller is formed on the image surface does not occur.

Figure 3:
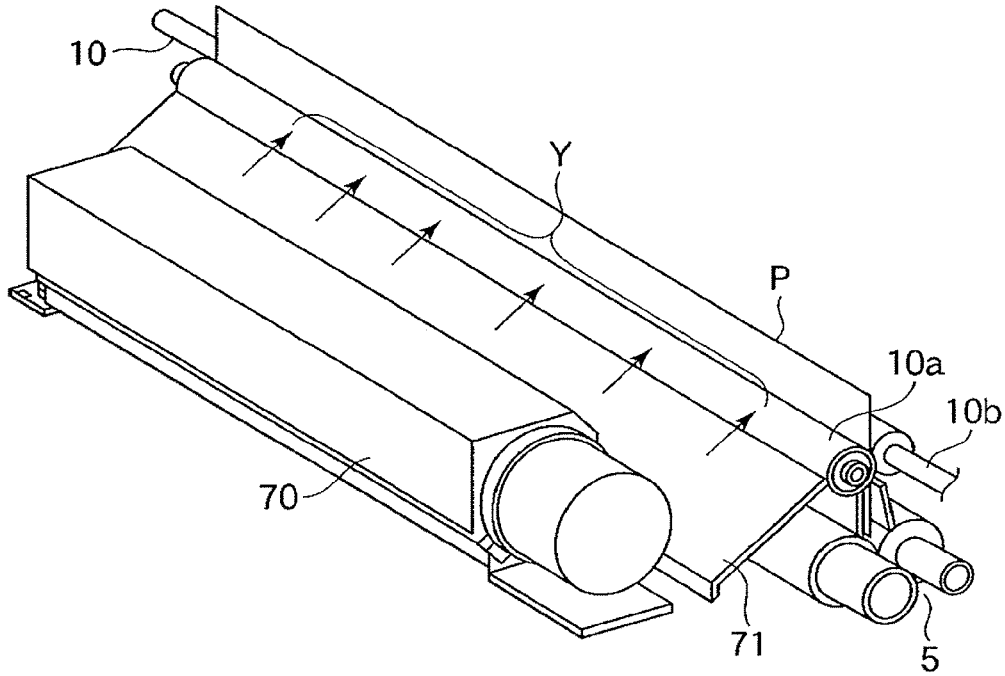
FIG. 3 is a diagram showing a state of cooling the cooling rollers.

Reference numeral 71 denotes a first duct serving as a duct for the cooling roller (endothermic roller) and serving as one of blow-off portions forming an air duct to blow off the cooling air generated by the cooling fan 70 to the cooling roller 10*a*. The first duct 71 is constructed so as to blow off the cooling air toward the downstream portion of the cooling roller 10*a* as shown in FIGS. 1 and 3.

Figure 4:
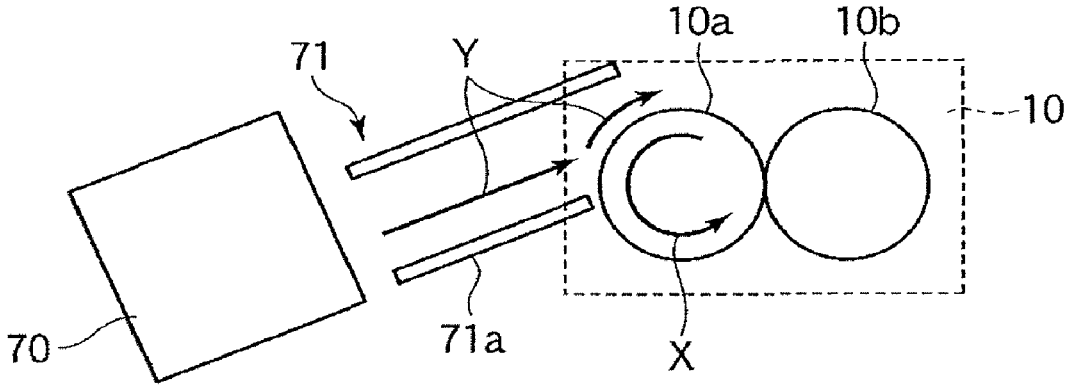
FIG. 4 is a diagram for explaining a cooling method of the cooling rollers.

FIG. 4 is a detailed diagram showing the state where the cooling air blown off by the first duct 71 collides with the cooling roller 10*a*. Although the cooling air is blown off to the cooling roller 10*a* of the image surface side in the embodiment, it is also possible to use a construction in which the cooling air is blown off to the cooling roller 10*b* of the non-image side.

As shown in FIG. 4, the cooling air guided by the first duct 71 forms a streamline direction Y along a slant surface 71*a* of the first duct 71. The cooling roller 10*a* is rotating in a rotating direction X in order to convey the sheet P in the conveying direction.

Therefore, the streamline direction Y of the cooling air toward the downstream portion of the cooling roller 10*a* is equal to the direction (reverse direction) opposite to the rotating direction X of the cooling roller 10*a*. In other words, the first duct 71 blows off the cooling air toward the portion of the cooling roller 10*a* where the relative position with the first duct 71 corresponds to the downstream side of the cooling roller 10*a*, thereby enabling the blow-off direction of the cooling air to be set to the direction opposite to the rotating direction of the cooling roller 10*a*.

When the blow-off direction of the cooling air becomes the direction opposite to the rotating direction of the cooling roller 10*a* as mentioned above, a relative speed of the cooling air when seen from the cooling roller 10*a* is higher than that in the case where the cooling air is blown to the upstream side of the cooling roller 10*a*. The higher a speed of a fluid is, the larger a heat transfer coefficient (heat transfer by convection) between the surface of a solid and the fluid is. Therefore, since the relative speed is increased as mentioned above, the effect of cooling the cooling roller 10*a* is further improved.

Thus, the temperature of the sheet P can be efficiently and promptly decreased. Even in the case where the conveying path from the fixing roller pair 5 to the discharge tray 7 is shortened due to the miniaturization of the apparatus or the high-speed of the apparatus is realized, the inter-sheet adhesion can be efficiently prevented. Even in the case where the sheet P which has once been fixed at the time of creation of the duplex images is conveyed again to the image forming unit, the temperature elevation of the image forming unit that is caused by the temperature of the sheet P can be suppressed.

The first duct 71 guides the cooling air by the slant surface 71*a* in such a manner that it flows toward the portion of the cooling roller 10*a* serving as a downstream side thereof and does not flow toward the portion of the cooling roller 10*a* serving as an upstream side thereof. Therefore, an amount of air which flows to the upstream side of the cooling roller 10*a* decreases. Consequently, a degree of cooling when the fixing roller pair 5 provided on the upstream side of the cooling roller 10*a* is cooled by the cooling air decreases.

Figure 5:
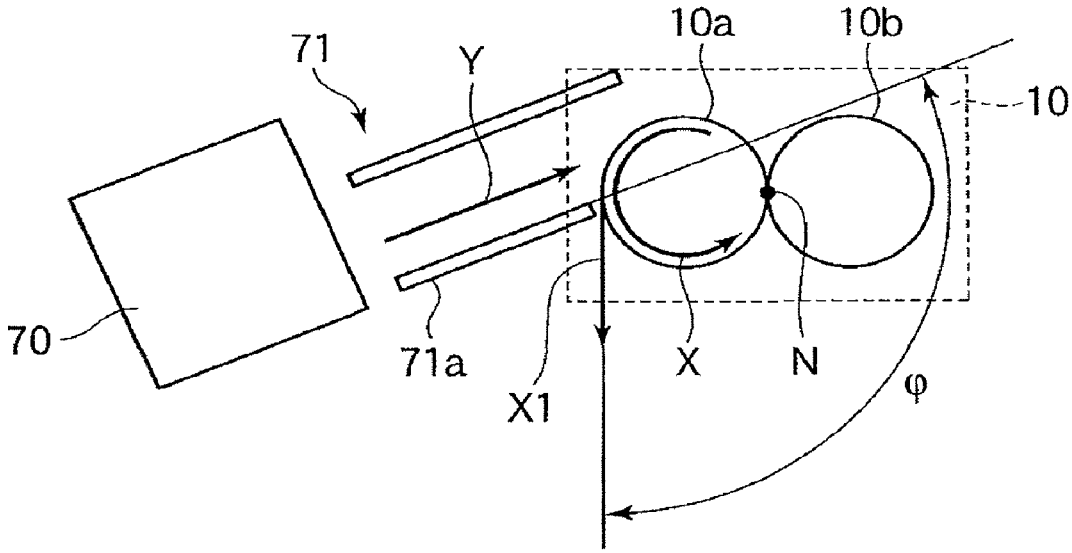
FIG. 5 is a diagram showing a blow-off direction of a cooling air to cool the cooling rollers.

By blowing off the cooling air in such a direction, as shown in FIG. 5, an angle ϕ between the streamline direction Y and a tangential direction X1 specified by the rotating direction X of the cooling roller 10*a* is equal to or larger than 90°. That is, the angle ϕ between the slant surface 71*a* of the first duct 71 forming the streamline direction Y and the rotational tangential direction X1 of the cooling roller 10*a* is also equal to or larger than 90°. In other words, the angle ϕ between the blow-off direction of the cooling air and the sheet conveying direction of the cooling roller pair 10 which is opposite to the direction X is less than 90°. That is, the direction in which the first duct 71 blows off the cooling air is inclined from the direction perpendicular to the conveying direction of the cooling roller pair 10 toward the downstream side of the conveying direction of the cooling roller pair 10.

Further, since an extension line of the slant surface 71*a* of the first duct 71 passes through the downstream side of a nip center N of the cooling roller pair 10, the blow-off direction of the cooling air is directed toward the downstream portion of the cooling roller pair 10.

Figure 6:
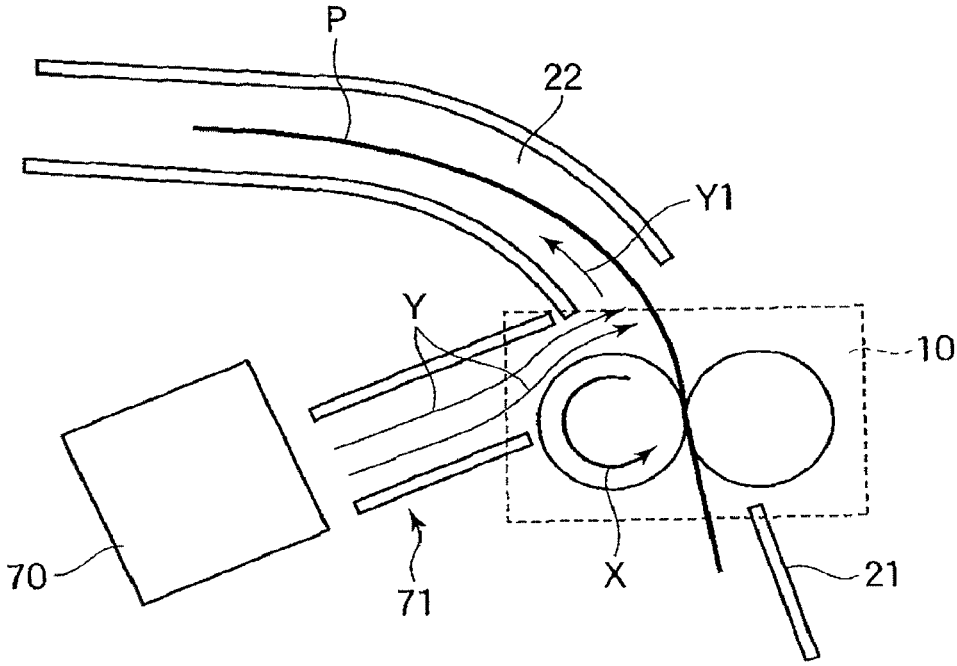
FIG. 6 is a diagram showing a flow of the cooling air at the time of the conveyance of a sheet.
Figure 7:
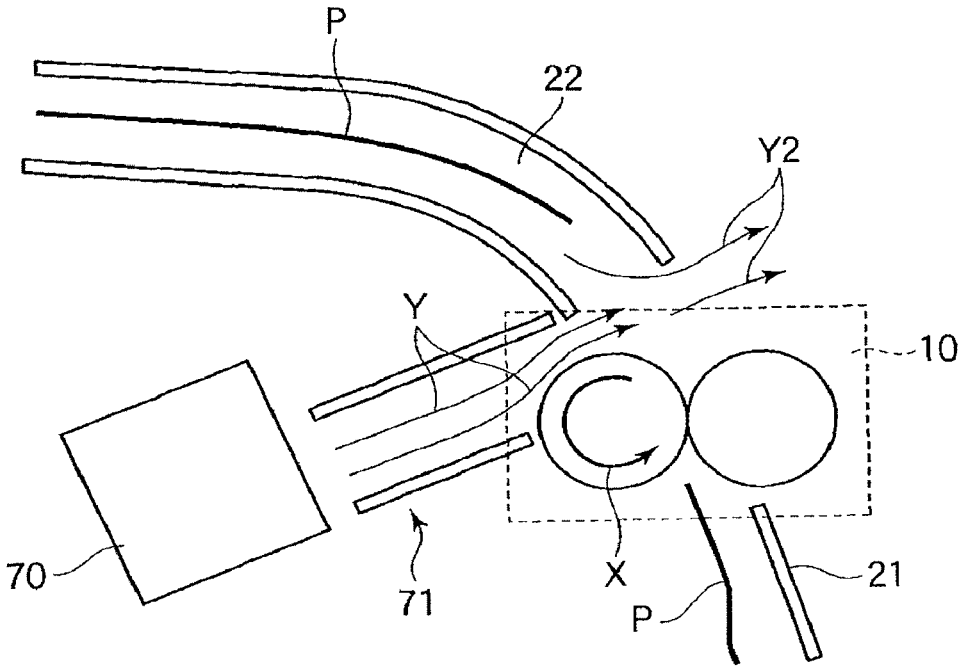
FIG. 7 is a diagram showing a flow of the cooling air after the passage through sheet.

Therefore, in the case where the sheet P passes through the cooling roller pair 10 as shown in FIG. 6, the cooling air which collided with the sheet P flows in the direction of a discharge conveying path 22 on the downstream side of the cooling roller pair 10 shown by an arrow Y1. Thus, the sheet P can be more effectively cooled. If the sheet P does not pass through the cooling roller pair 10, the cooling air is exhausted through an opening provided between the discharge conveying path 22 on the downstream of the cooling roller pair 10 and a post-fixing conveying path 21 as shown by an arrow Y2 in FIG. V. Thus, an amount of cooling air which flows into the conveying path on the upstream of the cooling roller pair 10 decreases.

By blowing off the cooling air toward the downstream side portion of the cooling roller 10*a* by the first duct 71 as mentioned above, the relative speed of the cooling air to the cooling roller 10*a* can be raised. Thus, even if the miniaturization and high speed of the apparatus are realized, the cooling roller 10*a* can be efficiently cooled.

Since it is possible to prevent the cooling air from flowing into the conveying path on the upstream of the cooling roller pair 10, the increase in heat generation amount in association with the temperature drop of the fixing roller pair 5 and the temperature elevation in the apparatus due to the flow of the air into the image forming unit can be also suppressed. As already mentioned, in the embodiment, since the rollers (refer to FIG. 2) whose outer peripheral surfaces are continuous are used as cooling rollers 10*a* and 10*b*, the effect of preventing the flow of the cooling air is further improved.

The second embodiment of the invention will now be described.

Figure 8:
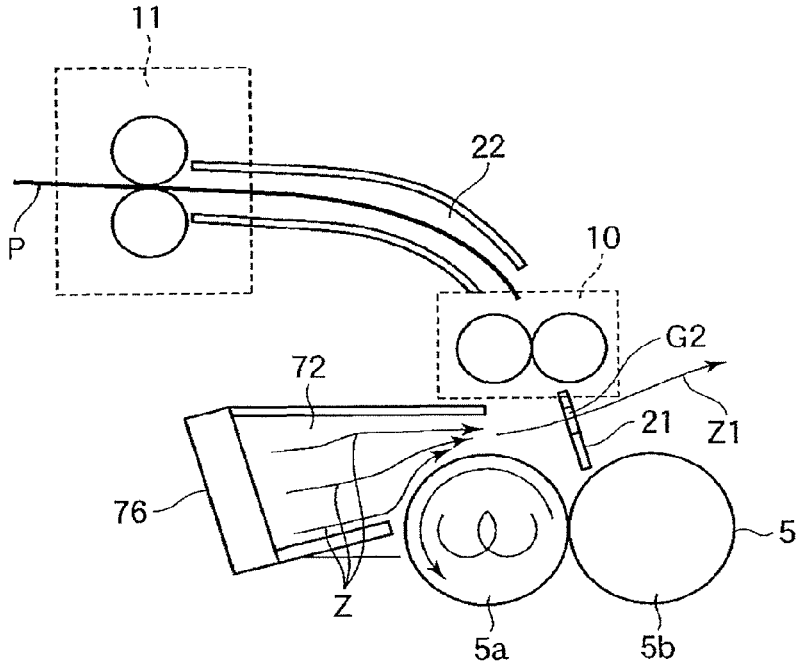
FIG. 8 is an enlarged diagram of a main section for explaining a construction of an image forming apparatus according to the second embodiment of the invention.
Figure 16:
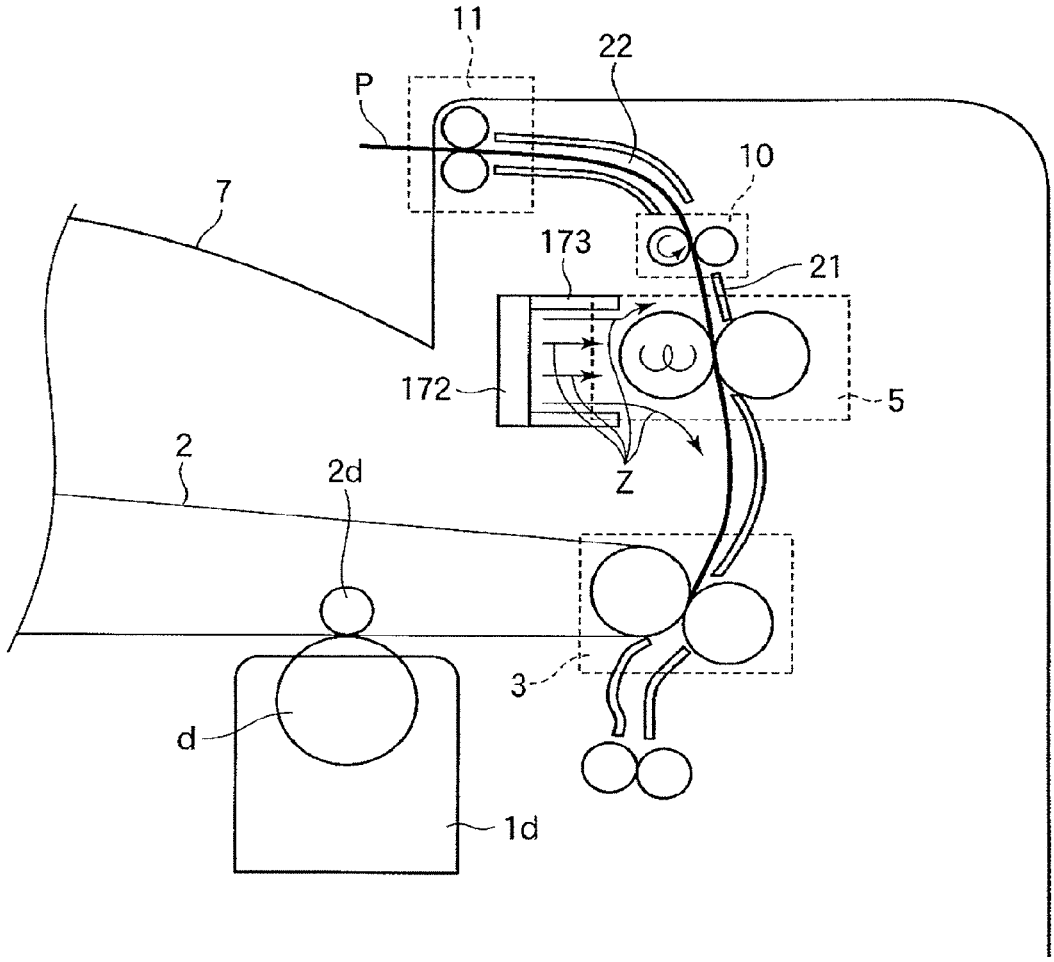
FIG. 16 is a diagram showing a flow of the cooling air when a fixing roller pair provided for the conventional image forming apparatus is cooled.

FIG. 8 is an enlarged diagram of a main section for explaining a construction of an image forming apparatus according to the second embodiment. In FIG. 8, the same or similar portions as those in FIG. 16 are designated by the same reference numerals.

In FIG. 8, reference numeral 76 denotes a cooling fan as a blowing device provided in an upper portion of the heating roller 5*a*. The cooling fan 76 cools the non-paper-passage region by blowing the cooling air to both edge portions of the heating roller 5*a*. Reference numeral 72 denotes a second duct for cooling the non-paper-passage region and serving as a duct for the heating roller as one of blow-off portions connected to the cooling fan 76.

Figure 9:
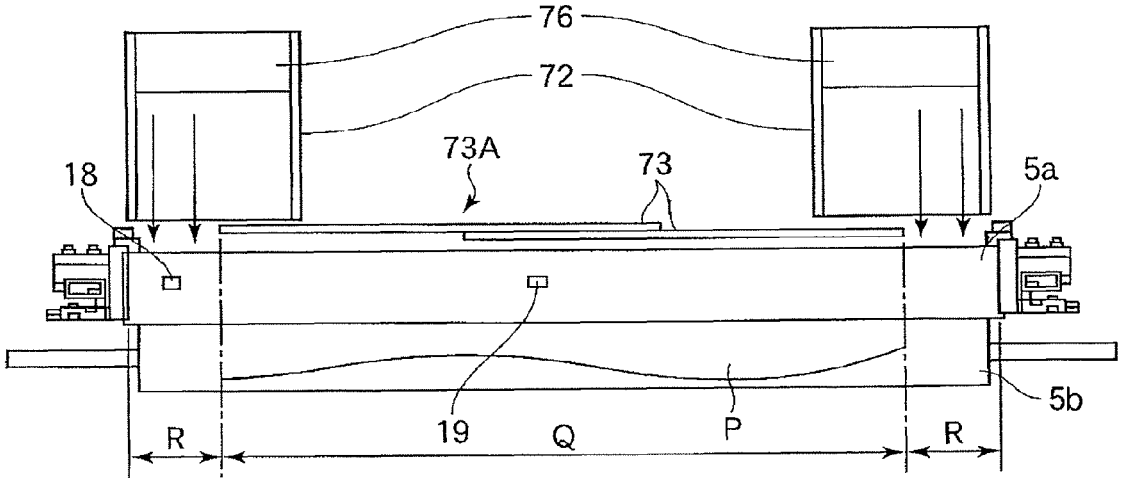
FIG. 9 is a side elevational view for explaining a shutter mechanism of a fixing roller pair provided for the image forming apparatus.

As shown in FIG. 9, when the sheets of a small size whose width is narrower than that of the sheets of the maximum size continuously pass through a fixing region Q, the second duct 72 functions so as to cool a non-paper-passage region R as a fixing region where the sheets of the small size do not pass.

Figure 10:
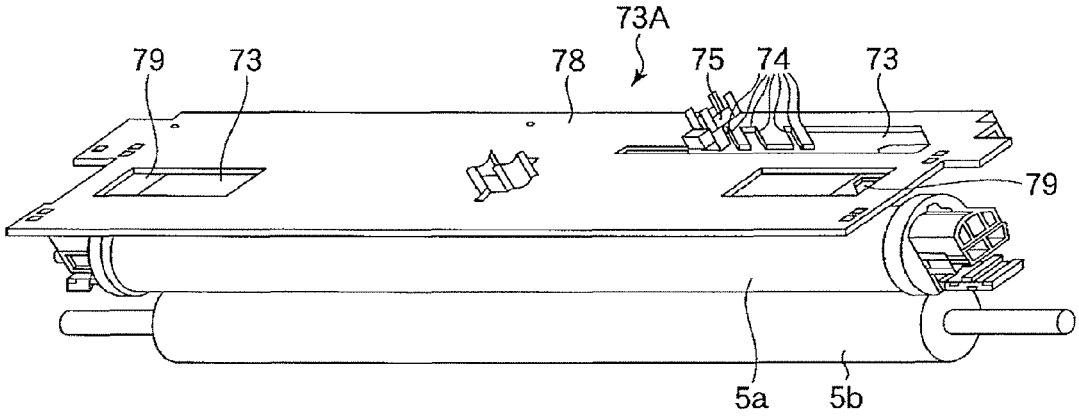
FIG. 10 is a perspective view for explaining the shutter mechanism.

A shutter mechanism 73A having a shutter 73 as shown in FIG. 9 is provided at an outlet of the second duct 72. The shutter 73 of the shutter mechanism 73A is held by a shutter frame 78 shown in FIG. 10 and opened or closed by a pulse motor and a driving gear (which are not shown).

A duct opening 79 is formed in the shutter frame 78 at a position corresponding to the second duct 72. As for the position of the shutter 73, an edge position 74 which has been predetermined on the basis of the sheet size is detected by a sensor 75, thereby allowing the shutter 73 to be opened to the position corresponding to each sheet size. Thus, an optimum opening width according to the size of sheet which passes is provided and the cooling air can be blown at the optimum width.

Two thermistors, that is, a main thermistor 19 and a sub-thermistor 18 are provided for the shutter mechanism 73A as shown in FIG. 9. The main thermistor 19 is arranged near the center in the longitudinal direction of the heating roller 5*a*. The sub-thermistor 18 is arranged near the edge portion of the heating roller 5*a*. Each of the two thermistors 18 and 19 is connected to a control circuit unit (CPU) (not shown) through an A/D converter.

On the basis of detection outputs of the main thermistor 19 and the sub-thermistor 18, the control circuit unit determines control contents of temperature adjustment of a fixing heater (not shown). A current supply to the fixing heater is controlled by a heater driving circuit unit as an electric power supplying unit (heating means).

For example, when the sheets of the small size whose width is narrower than that of the sheets of the maximum size are continuously fixed upon image creation, the temperature of the non-paper-passage region R rises. At this time, when the sub-thermistor 18 detects a certain temperature, the control circuit unit makes the cooling fan 76 operative and suppresses the temperature elevation of the non-paper-passage region R. Since it is cooled by the cooling air from the cooling fan 76, when the temperature of the sub-thermistor 18 drops to the certain temperature, the control circuit unit makes the cooling fan 76 inoperative.

Figure 11:
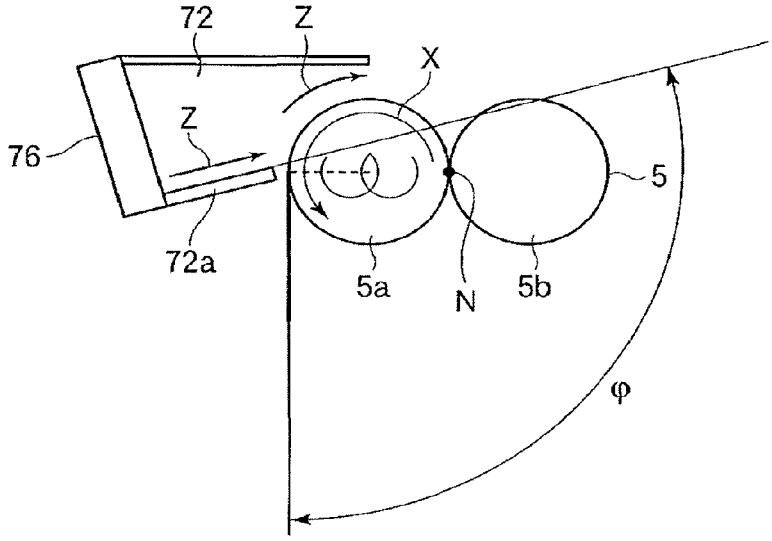
FIG. 11 is a diagram showing a blow-off direction of the cooling air to cool a heating roller of the fixing roller pair.

The cooling air guided by the second duct 72 forms a streamline direction Z along a slant surface 72*a* of the second duct 72 as shown in FIG. 11. The heating roller 5*a* is rotating in the rotating direction X in order to convey the sheet P in the conveying direction.

Therefore, the streamline direction Z of the cooling air toward the downstream portion of the heating roller 5*a* is equal to the direction (opposite direction) opposite to the rotating direction of the heating roller 5*a*. In other words, by blowing off the cooling air toward the portion of the heating roller 5*a* where the relative position with the second duct 72 corresponds to the downstream side of the heating roller 5*a*, the blow-off direction of the cooling air can be set to the direction opposite to the rotating direction of the heating roller 5a.

When the blow-off direction of the cooling air becomes the direction opposite to the rotating direction of the heating roller 5*a* as mentioned above, a relative speed of the cooling air when seen from the heating roller 5*a* is higher than that in the case where the cooling air is blown to the upstream side of the heating roller 5*a*. The higher the speed of the fluid is, the larger the heat transfer coefficient (heat transfer by convection) between the surface of the solid and the fluid is. Therefore, since the relative speed is increased as mentioned above, the effect of cooling the heating roller 5*a* is further improved.

Thus, the temperature of the non-paper-passage region R can be efficiently and promptly decreased and even if the high speed of the apparatus is realized, the improvement of the productivity of the sheets of paper of the small size can be realized.

By blowing off the cooling air in such a direction, as shown in FIG. 11, the angle ϕ between the streamline direction Y and the tangential direction X1 specified by the rotating direction X of the heating roller 5*a* is equal to or larger than 90°. That is, the angle ϕ between the slant surface 72*a* of the second duct 72 forming the streamline direction Z and the rotational tangential direction X1 of the heating roller 5*a* is also equal to or larger than 90°. In other words, the angle ϕ between the blow-off direction of the cooling air and the sheet conveying direction of the heating roller 5*a* which is opposite to the direction X is less than 90°.

The second duct 72 guides the cooling air by the slant surface 72*a* in such a manner that it flows toward the portion of the heating roller 5*a* serving as a downstream side thereof and does not flow toward the portion of the heating roller 5*a* serving as an upstream side thereof. Therefore, an amount of cooling air which flows to the upstream side of the heating roller 5*a* decreases. Consequently, an amount of air of the high temperature near the heating roller 5*a* which flows to the image forming unit provided on the upstream side of the heating roller 5*a* decreases.

Further, since an extension line of the slant surface 72*a* of the second duct 72 passes through the downstream of a nip center N of the heating roller 5*a* and the pressing roller 5*b*, the blow-off direction of the cooling air is directed toward the downstream portion of the fixing roller pair S.

Therefore, the cooling air which collided with the non-paper-passage portion of the heating roller 5*a* flows in the direction of the post-fixing conveying path 21 on the downstream of the heating roller 5*a*, passes through a guide opening portion G1, and is ejected. Thus, the cooling air does not flow into the conveying path on the upstream of the heating roller pair 5.

By blowing off the cooling air toward the downstream side portion of the heating roller 5*a* by the second duct 72 as mentioned above, the relative speed of the cooling air to the heating roller 5*a* can be raised. Thus, even if the miniaturization and high speed of the apparatus are realized, the non-paper-passage region R of the heating roller 5*a* can be efficiently cooled. Since it is possible to prevent the cooling air from flowing into the conveying path on the upstream side of the heating roller 5*a*, the increase in heat generation amount in association with the temperature drop of the fixing roller pair 5 and the temperature elevation in the apparatus due to the flow of the air into the image forming unit can be also suppressed.

The third embodiment of the invention will now be described.

Figure 12:
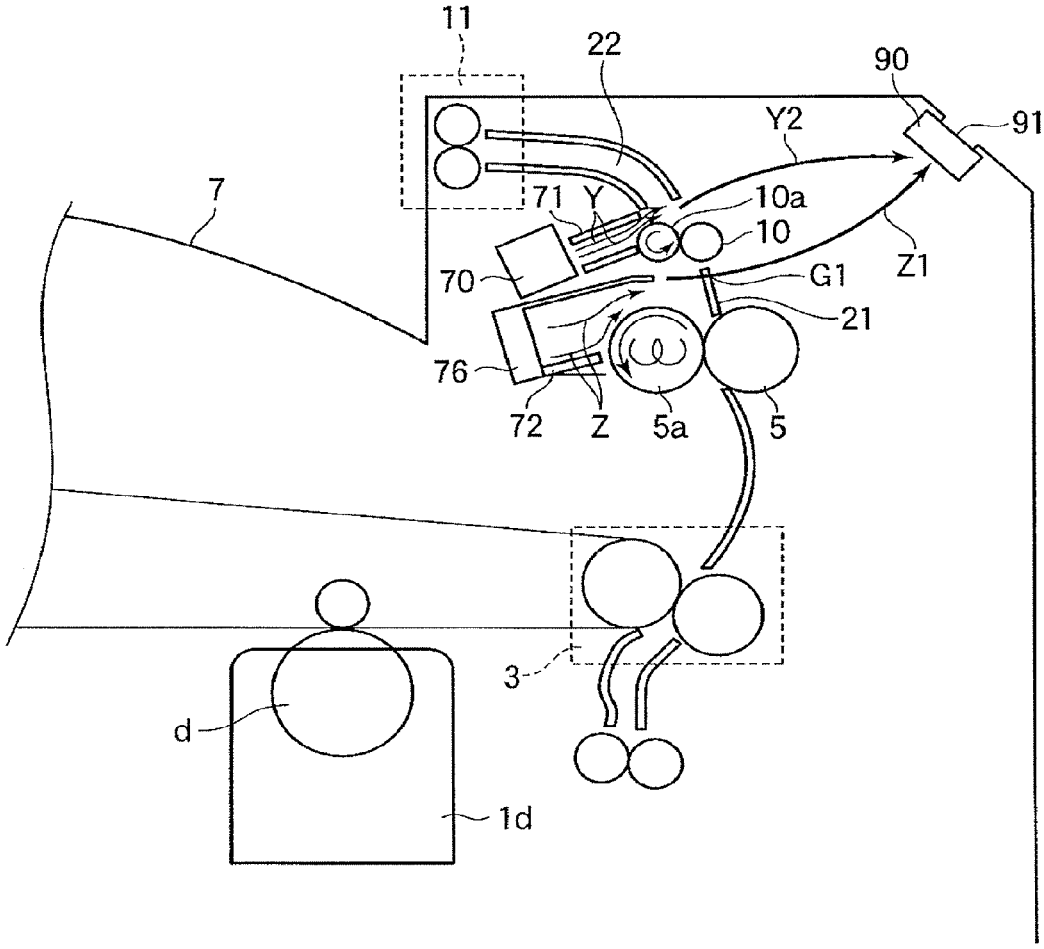
FIG. 12 is an enlarged diagram of a main section for explaining a construction of an image forming apparatus according to the third embodiment of the invention.

FIG. 12 is an enlarged diagram of a main section for explaining a construction of an image forming apparatus according to the third embodiment. In FIG. 12, the same or similar portions as those in FIGS. 11 and 8 are designated by the same reference numerals.

In FIG. 12, reference numeral 90 denotes an exhaust fan. The exhaust fan 90 is provided to collect the cooling air after it collided with the non-paper-passage portions of the cooling roller 10*a* and the heating roller 5*a* and exhaust it to a same exhaust port 91. In the third embodiment, it is assumed that the cooling fans 70 and 76, the first duct 71, and the second duct 72 having the constructions described in the foregoing first and second embodiments are arranged.

When the cooling air is blown off from the first duct 71 and the second duct 72 by the cooling fans 70 and 76, first, the cooling air collides with the non-paper-passage portions of the cooling roller 10*a* and the heating roller 5*a* and flows along the outer periphery of the downstream portion of each of them. After that, the cooling air is inhaled by the exhaust fan 90 and exhausted from the same exhaust port 91 as shown by arrows Y2 and Z1.

Since the cooling air blown off from the first duct and the second duct 72 is exhausted from the same exhaust port 91, there is no need to individually provide the exhaust fans 90 and the costs can be reduced. Further, since an occupation area of the exhaust port can be reduced, a valid space of the user operation which is formed by the region where the hot exhaust air is not exhausted can be increased.

Although the cooling fans 70 and 76 have been provided for the first duct 71 and the second duct 72 in the embodiment, respectively, the cooling air from one cooling fan can be also guided to the cooling roller 10*a* and the heating roller 5*a* by properly designing the shapes of the first duct 71 and the second duct 72.

As mentioned in the embodiment, since the cooling air is blown off by the blow-off portion toward the portion of the rotary member where the relative position with the blow-off portion corresponds to the downstream side of the rotary member, the relative speed of the cooling air to the rotary member can be raised. Consequently, even if the miniaturization and high speed of the apparatus are realized, the rotary member can be efficiently cooled.

While the present invention has been described with reference to exemplary embodiments, it is to be understood that the invention is not limited to the disclosed exemplary embodiments. The scope of the following claims is to be accorded the broadcast interpretation so as to encompass all such modifications and equivalent structures and functions.

This application claims the benefit of Japanese Patent Application No. 2005-265421 filed Sep. 13, 2005, which is hereby incorporated by reference herein in its entirety.

What is claimed is:

1. An image forming apparatus comprising:

a fixing device that fixes an unfixed image onto a sheet using heat;

a pair of rotary members that conveys the sheet and is provided downstream of said fixing device in a sheet conveying direction, wherein said pair of rotary members is configured as heat absorption rollers to absorb heat from the sheet when where said pair of rotary members conveys the sheet;

a sheet conveying path through which the sheet conveyed by said pair of rotary members passes, said sheet conveying path being provided downstream of a nip of said pair of rotary members in the sheet conveying direction;

a blowing device that blows a cooling air, which cools said pair of rotary members;

a blow-off portion, configured as a duct, that guides the cooling air from said blowing device toward one rotary member of said pair of rotary members, wherein a blow-off direction of the cooling air guided by the blow-off portion is a direction opposite to a rotation direction of a portion of said one rotary member of said pair of rotary members with which the cooling air collides; and an exhaust fan, provided at an opposite side of the sheet conveying path from said blow-off portion, which exhaust the cooling air that is guided by said blow-off portion and that flows across said sheet conveying path.

2. The image forming apparatus according to claim 1, wherein the blow-off direction of the cooling air is inclined downstream in the sheet conveying direction of said pair of rotary members with regard to a direction perpendicular to the sheet conveying direction of said pair of rotary members.

3. The image forming apparatus according to claim 1, wherein the duct guides the cooling air downstream of a center of a nip of the heat absorption rollers in the sheet conveying direction.

4. The image forming apparatus according to claim 1, wherein the heat absorption rollers have cylindrical shapes whose outer peripheral surfaces continue in width directions of the heat absorption rollers.

5. The image forming apparatus according to claim 1, wherein the fixing device includes a heat rotary member and a pressure rotary member, which contacts said heat rotary member, wherein said blow-off portion further includes a duct for the heat rotary member that guides the cooling air to the heat rotary member, and wherein the cooling air blown from the ducts for the heat rotary member and for the heat absorption roller is exhausted in a common exhaust port.

6. The image forming apparatus according to claim 1, wherein the duct is configured to prevent the cooling air from flowing upstream of the heat absorption roller in the sheet conveying direction in said sheet conveying path.

7. The image forming apparatus according to claim 1, further comprising an exhaust port that exhausts the cooling air by said exhaust fan, the exhaust port being provided at an opposite side of said blow-off portion.

8. The image forming apparatus according to claim 1, further comprising:

a transfer nip that transfers a toner image borne on an image bearing member;

a fixing nip, provided in the fixing device, that fixes a toner image transferred onto the sheet using heat, the fixing nip being provided downstream of said transfer nip in the sheet conveying direction, wherein said pair of rotary members conveys the sheet that passed through said fixing nip, said pair of rotary members being provided downstream of said fixing nip in the sheet conveying direction; and an exhaust port that exhausts the cooling air exhausted by said exhaust fan, the exhaust port being provided at an opposite side of the sheet conveying path from said blow-off portion and downstream of said fixing nip in the sheet conveying direction.

9. An image forming apparatus comprising:

a pair of rotary members that conveys a sheet;

a sheet conveying path through which the sheet conveyed by said pair of rotary members passes, said sheet conveying path being provided downstream of a nip of said pair of rotary members in a sheet conveying direction;

a blowing device that blows cooling air, which cools said pair of rotary members;

a blow-off portion that guides the cooling air from said blowing device toward one rotary member of said pair of rotary members, wherein a blow-off direction of the cooling air guided by the blow-off portion is direction opposite of a rotation direction of a portion of said one rotary member of said pair of rotary members with which the cooling air collides, and wherein said blow-off portion is configured to prevent the cooling air from flowing upstream of the nip of said pair of rotary members in the sheet conveying direction in said sheet conveying path; and an exhaust fan, provided at an opposite side of the sheet conveying path from said blow-off portion, which exhaust the cooling air that is guided by said blow-off portion and that flows across said sheet conveying path.

10. The image forming apparatus according to claim 9, further comprising:

a transfer nip that transfers a toner image borne on an image bearing member, wherein said pair of rotary members forms a fixing nip that fixes the toner image transferred onto the sheet using heat, the fixing nip being provided downstream of said transfer nip in the sheet conveying direction, and wherein said image forming apparatus includes and exhaust port that exhausts the cooling air exhausted by said exhaust fan, the exhaust port being provided at an opposite side of the sheet conveying path from said blow-off portion downstream of said fixing nip in the sheet conveying direction.

11. The image forming apparatus according to claim 9, wherein the blow-off direction of the cooling air is inclined downstream in the sheet conveying direction of said pair of rotary members with regard to a direction perpendicular to the sheet conveying direction of said pair of rotary members.

12. The image forming apparatus of claim 9, wherein the blow-off portion guides the cooling air downstream of a center of a nip of said pair of rotary members in the sheet conveying direction.

13. The image forming apparatus of claim 9, wherein said pair of rotary members have cylindrical shapes whose outer peripheral surfaces continue in width directions of said pair of rotary members.

14. The image forming apparatus according, to claim 9, further comprising:

a fixing unit, including a heat rotary member and a pressure rotary member that contacts said heat rotary member, which fixes an unfixed image onto the sheet, wherein said pair of rotary members is provided downstream of said fixing unit in the sheet conveying direction, and said one rotary member of said pair of rotary members is configured as a heat absorption roller that adsorbs heat from the sheet in case where said pair of rotary members conveys the sheet, wherein said blow-off portion includes a first duct for the heat rotary member that guides the cooling air to the heat rotary member and a second duct for the heat absorption roller that guides the cooling air to the heat absorption roller, and wherein the cooling air blown from the first duct and second duct is exhausted in a common exhaust port.

15. The image forming apparatus according to claim 9, further comprising:

a transfer nip that transfers a toner image borne on an image bearing member, a fixing nip that fixes a toner image transferred onto the sheet using heat, the fixing nip being provided downstream of said transfer nip in the sheet conveying direction, wherein said pair of rotary members conveys the sheet that passed through said fixing nip, said pair of rotary members being provided in an downstream of said fixing nip; and an exhaust port that exhausts the cooling air exhausted by said exhaust fan, the exhaust port being provided at an opposite side of the sheet conveying path from said blow-off portion and downstream of said fixing nip in the sheet conveying direction.

16. The image forming apparatus according to claim 9, wherein the blow-off portion is configured as a duct which has a surface that guides the cooling air, and the surface extends toward an outer peripheral surface of said one rotary member of said pair of rotary members, and wherein an extension line of the surface passes through a downstream side of the nip of said pair of rotary members in the sheet conveying direction.

17. The image forming apparatus according to claim 9, wherein said pair of rotary members is configured as a fixing unit that fixes an unfixed image onto the sheet using heat, wherein said one rotary member of said pair of rotary members is a heat rotary member, and the other rotary member of said pair of rotary members is a pressure rotary member that contacts the heat rotary member, and wherein said blow-off portion is configured as a duct for the heat rotary member, the duct guides the cooling air to the heat rotary member.

18. The image forming apparatus according to claim 17, wherein the duct for the heat rotary member guides the cooling air toward both ends of the heat rotary member, downstream of a center of the nip between the heat rotary member and pressure rotary members in the sheet conveying direction.

* * * * *